United States Patent [19]

Johnston et al.

[11] 3,981,236

[45] Sept. 21, 1976

[54] PRINTHEAD FOR IMPACT PRINTER

[75] Inventors: Ross W. Johnston, Norristown; Barrie W. Witty, Glenside, both of Pa.

[73] Assignee: Sperry Rand Corporation, New York, N.Y.

[22] Filed: Nov. 3, 1975

[21] Appl. No.: 628,341

Related U.S. Application Data

[63] Continuation of Ser. No. 449,865, March 11, 1974, abandoned.

[52] U.S. Cl. ..... 101/93.14; 101/93.34; 101/93.48

[51] Int. Cl.[2] ..... B41J 1/20

[58] Field of Search ..... 101/93.09, 93.14, 93.28, 101/93.29–93.34, 93.48, 93.02; 197/18, 53

[56] References Cited

UNITED STATES PATENTS

| | | | |
|---|---|---|---|
| 3,035,156 | 1/1972 | Krebs et al. | 101/93.33 |
| 3,128,693 | 4/1964 | Thiemann | 101/93.09 |
| 3,177,803 | 4/1965 | Antonucci | 101/93.34 |
| 3,301,177 | 1/1967 | Shepard | 101/93.33 |
| 3,309,989 | 3/1967 | Solheim et al. | 101/93.34 |
| 3,670,647 | 6/1972 | Funk et al. | 101/93.02 X |
| 3,735,698 | 5/1973 | Lenders et al. | 101/93.29 X |
| 3,759,174 | 9/1973 | Quirijnen | 101/93.28 |

FOREIGN PATENTS OR APPLICATIONS

| | | | |
|---|---|---|---|
| 1,210,224 | 2/1966 | Germany | 101/93.48 |

*Primary Examiner*—Edward M. Coven
*Attorney, Agent, or Firm*—William E. Cleaver; John B. Sowell

[57] ABSTRACT

A printhead assembly, having an individual print hammer and actuator assembly for every other column of line print, includes a low mass hammer and a hairpin spring coupled to the hammer rear portion, and an actuator assembly with side arms meeting at the arm tip for rapidly impacting characters on a type band. A plural flexure spring assembly provides uniform stress during actuator assembly movement and enables hammer and actuator positional adjustment to be made by frontal access, and a slotted bearing assembly inclines each print hammer at a slight angle off the perpendicular to the print line and the plane of the record medium.

1 Claim, 4 Drawing Figures

PRINTHEAD FOR IMPACT PRINTER

This is a continuation of appliction Ser. No. 449,865, filed Mar. 11, 1974, now abandoned.

BACKGROUND OF THE INVENTION

1. Field of the Invention

This invention relates to impact printers and more particularly to a print hammer mechanism and print heed for use in moderate speed printers such as on the fly printers.

2. Description of the Prior Art

The rapid advances in the computer art have given rise to many types of moderate speed printing devices, i.e. printers which print from 500 to 1,000 lines per minute of information. Such equipment generally receives electrical output signals from the computer, and punches, prints or otherwise makes visible characters on a record medium to record the information processed by the computer. Generally such printers are of the back printing type wherein type characters on a type carrier (such as drum, chain, belt etc.) are moved past print positions behind a document on which printing is to be effected. In the impact printers, individual type hammers are provided generally for each column, and the type hammer is impelled to impact the record and a ribbon or other like instrument against the raised type characters on the type carrier to effect printing on the record medium.

The problem of rapidly providing high quality printout is related to many factors. In many applications there is a demand for multiple copies, with six or more copies being a typical requirement. In such applications the record medium is therefore a stacked form of sheets with carbon papers interleaved between the sheets. In the backtype printing printers, a multiple copy record medium is generally inserted into the printer, intermediate a print hammer array and a type carrier and ribbon. In any event, one of the problems associated with such printers is providing the requisite amount of impact energy to the print hammer means in order to legibly print at least six copies.

Another associated problem relates to the relationship between the impact hammer means and the type carrier. Where the type carrier is a relative stiff dense immovable carrier such as a print drum, a more massive hammer may be used since the type carrier does not resonate and does not provide as much dampening of the hammer motion. Where, however, the type carrier is a relatively flexible carrier, such as an endless flexible type band which resonates, the band after impact must return to its home position, something not required of a drum or wheel, which is a solid member. Since such endless bands commonly have a minute airspace behind the band, it is necessary to also move the band during the hammer contact time and thus the contact time with a band carrier typically tends to be greater than the contact time with a drum carrier, and excessive contact times result in reduced print quality. The longer that the print hammer mechanism is in contact with a moving type carrier, the more smear and other nondesirable print characteristics will be experienced. Such a phenomena presents a greater problem for the print head mechanism, since it can only be overcome by use of a hammer with lower mass. The dual problems of a low mass print hammer and a higher impact energy in turn both present problems to the design of the entire print head. One of the more acute problems presented is that with such a band type printer, the actuator device design becomes extremely critical, since far greater terminal velocities are required to get a print force out of a low mass hammer. As will be seen hereinafter, according to the novel print hammer we have provided, the aforementioned problem is solved by providing a low rotational inertia arm and uniform stress pring assembly to get an efficient transfer of energy from the actuator circuit into the moving hammer. By providing a low mass hammer and a low mass actuator arm with very high accelerations, the level of print quality is maintained. By way of example, the velocity of the print hammer, for one type of use which is made of one invention, is in excess of 200 inches per second.

Another problem associated with prior art impact printers relates to the normal maintenance required after the printer has been operated over a certain period of time. It is most desirable to keep the down time for maintenance as low as possible. With impact printers, one common form of maintenance relates to the print hammer array adjustments due to either failure of a part, wearing of parts of actuators, hammer, etc. or magnetic aging of parts. With prior art print hammers, the adjustments were made by gaining access through the rear of the printer, thereby requiring some disassembly and hence inconvenience. Hence, another of the object of this invention is to provide a print hammer assembly wherein adjustments or replacements can be done by gaining access to the print station from the front of the machine, eliminating disassembly.

It is yet another object of this invention to provide a print hammer and assembly therefor in which the hammer face is of double width, i.e. which the hammer face is sufficiently wide to occupy two columns of print locations, so that only one hammer and assembly therefor is provided for every other print column.

Prior art patents relating to impact hammers and assemblies therefor made of record in this application are U.S. Pat. Nos. 3,164,084; 3,188,947; 3,241,480 and 3,640,217.

The foregoing objects and other considerations are realized in one embodiment of an impact print head assembly in which an armature, base and side arms constitute an actuator for moving a hammer from a ready position toward the moving type carrier. Three leaf-type flexure springs are arranged with portions secured to the armature at one location and the base at another location so that a simple beam deflection is obtained and the energy imparted to the moving parts is absorbed uniformly by the spring assembly portion intermediate the two locations. In addition, the print hammers are inclined at a slight angle off a perpendicular in the plane of the hammer array to the print line, and each hammer has a double width face so that only one hammer and actuator assembly is required for every other column.

The foregoing and other objects, features and advantages of my invention will become further apparent from the following description of the invention, as illustrated in the accompanying drawing, in which.

DESCRIPTION OF THE PREFERRED EMBODIMENT

Figure 1:
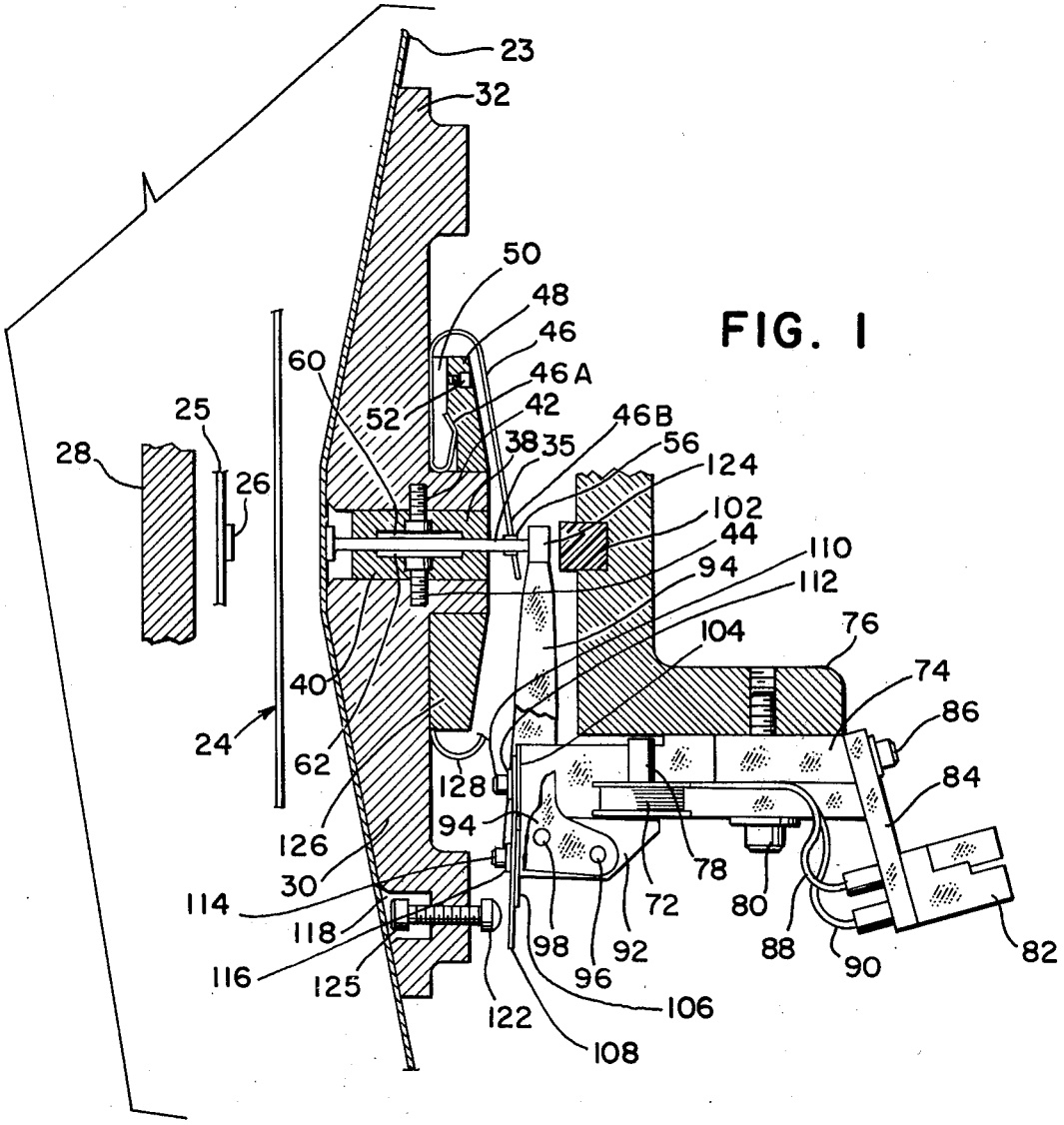
FIG. 1 is a partial section in an elevation view taken through the print hammer assembly and showing the relative positions of one print hammer and one actuator, as well as the type band.

Referring now to the drawing, FIG. 1 depicts a portion of the print station of an impact printer at which a paper record medium 23 is driven upwardly in a vertical plane past the print line, over the hammer assembly adjacent lower hammer mount 30 and upper hammer mount 32. The endless metallic band 25, having thereon a plurality of raised type characters 26, is rapidly rotated past the print line in a direction perpendicular to the plane of the drawing intermediate an inking ribbon 24 and a back-up bar 28. When a particular character 26 on type band 25 is adjacent one of the two columns opposite which the print hammer face 36 is located, the hammer 35 is impelled against record medium 23, in a manner to be explained hereinafter, and the medium 23 and ribbon 24 strike character 26 forcing type band 25 to strike the back-up bar 28, and the desired character is printed on record medium 23 at the desired location.

The print head assembly depicted in FIG. 1 is adapted to be mounted on the frame of the printer (not shown). The lower hammer mount 30 and the upper hammer mount 32 form a split frame assembly. Upper mount 32 has a split bearing half 38 mounted thereon by screws 42 which are inserted through the cutout 60 in the bearing 38, while lower mount 30 has a split bearing half 40 mounted thereon by screws 44 inserted through cutout 62 in bearing 40. Low mass print hammers 35, each having a mass of about one-half a gram, are slidably mounted in slots located in lower bearing half 40, as described below, and are retained for relatively friction free horizontal movement by the unslotted flat upper bearing half 38. In the preferred embodiment, the hammers 35 are made of steel for long life, and the self lubricating bearings 38 and 40 are made of a material such as OILITE.

The upper hammer mount 32 is provided with a plurality of molded plastic hammer return spring retainers 48, one for each hammer 35 and spring 46 provided. Each return spring retainer 48 is provided with a slot 50 through which the fixed end 46A of a hairpin spring 46 is inserted and retained. Each of the return spring retainers 48 is mounted into the upper hammer mount 32 by a threaded screw 52, only a portion of which is shown in the drawing for simplicity.

Figure 2:
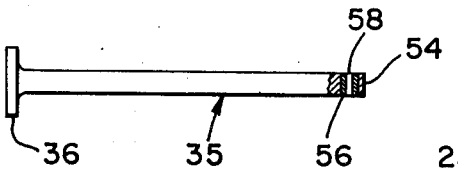
FIG. 2 is an enlarged plan view of one of the preferred embodiment print hammers.
Figure 3:
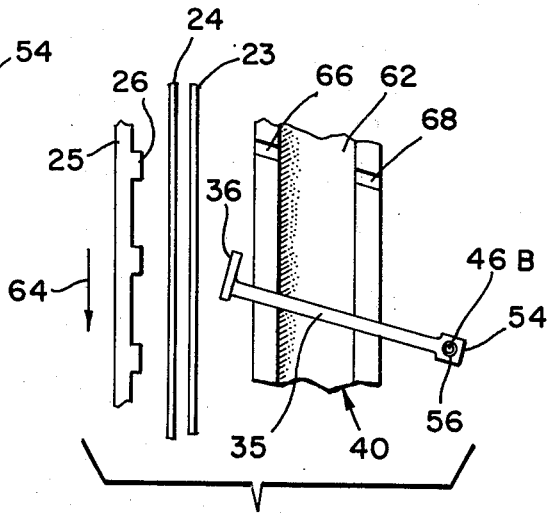
FIG. 3 is an enlarged elevation view in partial section taken through the print hammer assembly, showing a double width print hammer aligned by the lower bearing half.

As is shown in FIGS. 2 and 3, the free or movable end 46B of hairpin cantilever spring 46 may be engaged with an end portion of hammer 35 near the rear portion 54. Near the rear portion 54 there is provided a suitable guide means 56 which may be a plastic bushing 56 inserted in a hammer aperture located thereat by a process such as injection molding. Bushing 56 has an aperture 58 which is concentric with the hammer aperture in which the bushing is molded. The hairpin cantilever spring 46 has its movable end 46B inserted into and through aperture 58 in the bushing so that end 46B protrudes therethrough and spring 46 is retained therein by friction without any fastening means.

FIG. 3 depicts a hammer 35 which is one of a plurality of hammers aligned in a horizontal plane adjacent the print line. Hammer 35 is placed in a pair of slots which are identically inclined at a small angle off a line in the horizontal plane of the hammers which is perpendicular to the print line. The slots would appear like the slots 66 and 68 with the hammer removed. With the type band 25 moving along the print path in the direction of the arrow 64, it can be seen that the hammers, such as hammer 35, are not aligned perpendicular to the type band 25, ribbon 24 and paper 23, but are set at the same slight angle as the slots, which in the preferred embodiment is 0° 15mins. In the drawing this angle is exaggerated for descriptive purposes. As mentioned previously, hammer striker face 36 is of double width, i.e. as wide as two columnar locations along the print line, since it is effective for two print columns. By having the hammers so inclined into the paper, ribbon and type band, the leading or "upstream" edge of the hammer (i.e., the upper edge in FIG. 3) is inhibited from digging into paper 23 as the type band 25, while moving, tends to drag the paper 23 with it. We have found that the small inclination into band 25 is effective in minimizing smearing and paper damage which has a tendency to occur when the hammer 35 has been placed along the perpendicular, especially when the column adjacent the leading edge of hammer 35 is printed. The hammer arm is secured to the portion of striker face 36 closest to the record medium 23. This off-center attachment (exaggerated in FIG. 3) is provided purposely to minimize hammer rotational effects caused by the drag of the type band 25.

The actuator assembly shown in FIG. 1 is provided with an electrical coil 72 secured to actuator frame 74 by a plastic retainer 78 which clips onto frame 74. Actuator frame 74 is in turn mounted on the actuator casting mount 76 by a plurality of screws 37. An electrical connector 82 is secured to plate 84 which plate 84 is in turn fastened to actuator frame 74 by a plurality of screws 86. Electrical wires 88 and 90 interconnect the connector 82 and the electrical coil 72. Printing occurs when the logic circuitry associated with the printer sends an electronic pulse to the connector 82 associated with the print hammer and actuator opposite the column where printing is to occur. The electronic pulse causes current to flow through electrical coil 72 starting the excitation of the magnetic circuit. The magnetic current comprises all the ferromagnetic material around coil 72 through an eliptical pattern, and include the armature block 92 and a pair of side arms (arranged in wishbone like fashion) one of which is side arm 94 shown secured to armature block 92 by rivets 96 and 98, and the other of which is secured to the opposite side of armature block 92 by the same rivets 96 and 98. The excitation starts magnetic flux flowing, causing an attraction of the magnetic pole pieces, i.e., the armature block 92 and coil block within 72. The magnetic attraction causes mechanical movement of the armature block 92 toward the coil which in turn causes the side arms, including side arm 94, to move rapidly contacting at its upper tip where the side arms join, the rear face 54 of hammer 35. As the armature assembly strikes the pole piece associated with coil 72, coming to an abrupt stop, hammer 35 moves rapidly picking up paper 23 and ribbon 24 causing impact with the character 26 on type band 25, against the back-up surface of 28.

Figure 4:
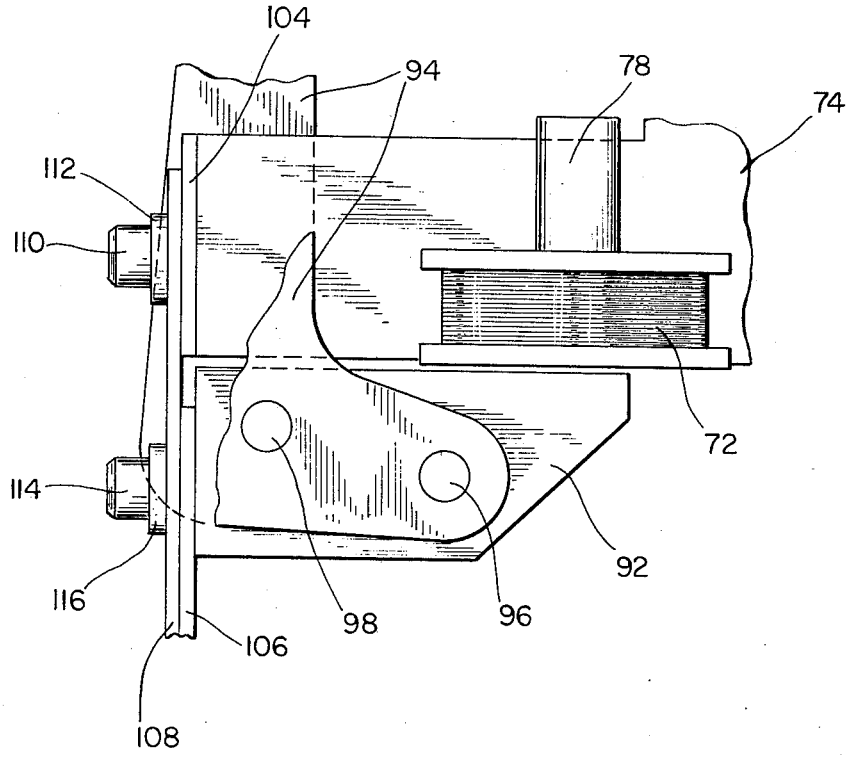
FIG. 4 is an enlarged section of FIG. 1 depicting the flexure spring arrangement.

Also shown in FIG. 1 is a uniform stress leaf flexure spring assembly which provides a uniform distribution of stress throughout the springs during the period of rapid acceleration by the actuator armature and side arms. The spring assembly, which resembles a simple beam deflection arrangement rather than a cantilever beam deflection arrangement, includes a first flexure spring 104 adjacent actuator frame base block 74, a second flexure spring 106 adjacent armature block 92, and a third longer flexure spring 108 which abuts all of spring 106 and substantially all of spring 104. A first cap screw 110 and washer 112 secures the upper portion of spring 108 and spring 104 to the actuator base block 74 with locating holes on the springs at the upper portion of spring 108 and at the center of spring 104. Another cap screw 114 and washer 116 secures the lower portion of spring 108 and spring 106 to the armature block 92 with locating holes on the springs below the center of spring 108 and above the center of spring 106. The spring assembly is thus supported at both ends and is loaded in the center, with substantially all of the energy generated by the mechanical attraction of the pole pieces being absorbed by the three spring and distributed, evenly across the lengths of the springs, entirely about the spring portions intermediate the two mounting screws 110 and 114. It is not clear why the energy is absorbed by this arrangement of flexure springs but it has been found that if only one spring, i.e, spring 108 is used it readily breaks but if the three flexure springs 104, 106 and 108 are arranged as shown in FIGS. 1 and 4, the spring arrangement does not readily break.

After impact with type band 25, hammer rebound begins and hammer 35 settles against the tip of actuator side arm 94, which in turn returns back against a plastic damper 102 which runs across the print station and is machined and glued into mounting casting 76. During rebound, the hammer return spring 46 and the armature flexure spring assembly returns the hammer and armature against damper 102 to settle out the vibration occurring during rebound off of type band 25. The assembly finally comes to a rest position determined by cap 122.

The arrangement of the actuator leaf spring assembly shown in FIG. 1 enables front adjustments to be made to the actuator side arm and hammer rear face positons which may be needed after the printer has been operated over a long period of time. As shown in FIG. 1, the lower hammer mount 30 is provided with a bored-out area 118 into which sits the face of a set screw 120. Set screw 120 is threaded into matching grooves in lower mount 30, and is provided with a polyurethane tip 122 molded onto the back end of screw 120. The at-rest position of the hammer 35 and side actuator arms can thus be easily adjusted by lifting record medium 23 and re-setting screw 120 from the front of the assembly. Tip 122 bears against the lower portion of flexure spring 106. Loosening screw 120 moves hammer 35 and actuator arm tip 124 toward damper 102 away from record medium 23 while tightening screw 120 gives the opposite adjustment.

In the above described print head assembly one-half of the actuators may be mounted on the lower half of the assembly, as shown in the drawing, and the other half of the actuators may be mounted on the upper half of the assembly. Likewise, half of the return springs may be retained by return spring retainers 48 mounted on upper hammer mount 32 and half of the return springs such as spring 128 may be retained by return spring retainers 126 mounted on lower hammer mount 30.

The above described impact printer is capable of speeds up to 800 lines per minute and employs only one hammer of double face width for every other column of line print thereby reducing the cost of the hammer array and actuator assemblies. Each hammer is inclined toward the band and paper. The plural flexure leaf spring assembly provides uniform stress during actuator impact movement and enables hammer and actuator positional adjustments to be made easily and quickly by frontal access. The assemblies herein described have an expected lifetime of 300 million cycles.

We claim:

1. An impact printer arrangement to operate in conjunction with a rotating type band and an inked ribbon to print characters on a record medium which is moved upwardly in a vertical plane in close proximity to said ribbon and to said type band, said type band formed and disposed to define a rotating path which lies perpendicular to said vertical plane, comprising: a hammer guide assembly formed and disposed to lie perpendicular to said vertical plane and to have a first side lying substantially parallel to said rotating path and in close proximity to said record medium, to said inked ribbon, and to said type band; said hammer guide assembly formed to have grooves therein, which grooves lie in a horizontal plane and which grooves are formed to lie at an angle less than 90° from said vertical plane with said angle opening toward the direction toward which said rotating type band is moving; a plurality of impact printer hammers each having a stricker face member formed integral with a hammer arm, each of said impact printer hammers disposed to have its hammer arm mounted in a different one of said grooves and further disposed in its associated one of said grooves so that its striker face member lies opposite said rotating path of said type band and so that when it is moved toward said type band it will strike said type thereon and which striker face member lies at a small angle from said vertical plane and which angle opens toward the direction from which said rotating type band is moving during its rotation; and means to drive each of said impact printer hammers toward said record medium, toward said inked ribbon, sand toward said type band whereby said striker face members will force said record medium against said ribbon and said type bands to effect printing of characters thereon with a minimum of smearing.

* * * * *

UNITED STATES PATENT OFFICE

CERTIFICATE OF CORRECTION

Patent No. 3,981,236 Dated September 21, 1976

Inventor(s) Ross W. Johnston et al.

It is certified that error appears in the above-identified patent and that said Letters Patent are hereby corrected as shown below:

Column 1, line 10, word "heed" - change word to "head".

Column 2, line 8, word "pring" - change word to "spring".

Column 2, line 14, word "one" - change word to "our".

Column 2, line 23, word "of" (second occurrence) - change word to "on".

Column 5, line 20, word "spring" - change word to "springs".

Signed and Sealed this

*Twenty-third* Day of *May 1978*

[SEAL]

*Attest:*

RUTH C. MASON
*Attesting Officer*

LUTRELLE F. PARKER
*Acting Commissioner of Patents and Trademarks*